US008651328B2

(12) United States Patent
Cittadino

(10) Patent No.: US 8,651,328 B2
(45) Date of Patent: Feb. 18, 2014

(54) PUMPING DISPENSER SHIELD

(75) Inventor: Antonio M. Cittadino, Appleton, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 108 days.

(21) Appl. No.: 13/182,674

(22) Filed: Jul. 14, 2011

(65) Prior Publication Data

US 2013/0015200 A1 Jan. 17, 2013

(51) Int. Cl.

| | |
|---|---|
| ***B67D 1/00*** | (2006.01) |
| ***B67D 7/14*** | (2010.01) |
| ***G21F 5/00*** | (2006.01) |
| ***G21C 11/00*** | (2006.01) |
| ***G21F 1/00*** | (2006.01) |
| ***G21F 3/00*** | (2006.01) |
| ***G21F 7/00*** | (2006.01) |
| ***G03B 11/00*** | (2006.01) |

(52) U.S. Cl.

USPC ..... 222/52; 250/515.1; 250/482.1

(58) Field of Classification Search

USPC ..... 222/52, 63, 181.3; 250/491.1, 515.1, 250/504 R, 482.1; 340/573.1

See application file for complete search history.

(56) References Cited

U.S. PATENT DOCUMENTS

| | | | |
|---|---|---|---|
| 2,187,868 | A | 3/1938 | Sweitzer |
| 2,898,009 | A | 8/1959 | Green |
| 3,273,752 | A | 9/1966 | Horeczky |
| 3,327,901 | A | 6/1967 | Yerkovich |
| 3,419,188 | A | 12/1968 | Matchett |
| 3,434,628 | A | 3/1969 | Ceraldi |
| 3,446,405 | A | 5/1969 | McCray |
| 3,940,938 | A | 3/1976 | Durham et al. |
| 4,030,665 | A | 6/1977 | Koyama |
| 4,349,131 | A | 9/1982 | Arabian |
| 4,413,649 | A | 11/1983 | Rodd et al. |
| 4,489,766 | A | 12/1984 | Montada |
| 4,573,612 | A | 3/1986 | Maddison et al. |
| 4,621,749 | A | 11/1986 | Kanfer |
| 4,722,372 | A | 2/1988 | Hoffman et al. |
| 4,730,550 | A | 3/1988 | Bramstedt et al. |
| 4,905,873 | A | 3/1990 | Loesel, Jr. et al. |
| 4,917,265 | A | 4/1990 | Chiang |
| 4,921,131 | A | 5/1990 | Binderbauer et al. |

(Continued)

FOREIGN PATENT DOCUMENTS

| | | | |
|---|---|---|---|
| CA | 2024877 | A1 | 3/1991 |
| EP | 0392238 | B1 | 1/1995 |
| GB | 2284800 | A | 6/1995 |

OTHER PUBLICATIONS

EcoCare Personnel Hygiene Systems, Local Distribution Systems, "Models NTP, NTR-2 and NTR-8 Hand Dispensing Systems"; 2006.

(Continued)

*Primary Examiner* — Paul R Durand
*Assistant Examiner* — Vishal Pancholi
(74) *Attorney, Agent, or Firm* — Sutherland Asbill & Breman LLP

(57) ABSTRACT

A dispenser apparatus for dispensing a flowable material includes a chassis portion, a sensor disposed proximate the chassis portion for sensing a presence of an object, a pump assembly arranged on the chassis portion, operative to dispense the flowable material responsive to receiving a signal from the sensor, and a shield member disposed proximate to the sensor.

26 Claims, 10 Drawing Sheets

(56) References Cited

U.S. PATENT DOCUMENTS

| | | | | |
|---|---|---|---|---|
| 4,921,150 | A | | 5/1990 | Lagergren et al. |
| 4,938,384 | A | | 7/1990 | Pilolla et al. |
| 4,946,070 | A | | 8/1990 | Albert et al. |
| 4,967,935 | A | | 11/1990 | Celest |
| 4,989,755 | A | | 2/1991 | Shiau |
| 5,014,880 | A | | 5/1991 | Loesel, Jr. et al. |
| 5,105,992 | A | | 4/1992 | Fender et al. |
| 5,165,577 | A | | 11/1992 | Ophardt |
| 5,186,360 | A | | 2/1993 | Mease et al. |
| D338,585 | S | | 8/1993 | Bell et al. |
| 5,235,214 | A | | 8/1993 | Vuong et al. |
| 5,248,066 | A | | 9/1993 | Olson et al. |
| 5,255,822 | A | | 10/1993 | Mease et al. |
| D341,741 | S | | 11/1993 | Allen et al. |
| D341,875 | S | | 11/1993 | Allen et al. |
| 5,265,772 | A | | 11/1993 | Bartasevich et al. |
| 5,271,530 | A | | 12/1993 | Uehira et al. |
| 5,282,552 | A | | 2/1994 | Ophardt |
| 5,289,952 | A | | 3/1994 | Gueret |
| 5,299,713 | A | | 4/1994 | Saitoh |
| 5,305,915 | A | | 4/1994 | Kamysz et al. |
| 5,305,916 | A | | 4/1994 | Suzuki et al. |
| 5,329,117 | A | | 7/1994 | Galili et al. |
| D350,665 | S | | 9/1994 | Ophardt |
| 5,344,047 | A | | 9/1994 | Chen |
| 5,348,189 | A | | 9/1994 | Cater |
| 5,370,267 | A | | 12/1994 | Schroeder |
| 5,373,970 | A | | 12/1994 | Ophardt |
| 5,431,309 | A | | 7/1995 | Ophardt |
| 5,443,236 | A | | 8/1995 | Bell et al. |
| 5,443,569 | A | | 8/1995 | Uehira et al. |
| 5,445,288 | A | | 8/1995 | Banks |
| 5,465,877 | A | | 11/1995 | Bell et al. |
| 5,477,984 | A | * | 12/1995 | Sayama et al. ..... 222/52 |
| 5,489,044 | A | | 2/1996 | Ophardt |
| 5,492,247 | A | * | 2/1996 | Shu et al. ..... 222/63 |
| 5,507,413 | A | | 4/1996 | Chen |
| D375,220 | S | | 11/1996 | Copeland et al. |
| D378,035 | S | | 2/1997 | Ophardt |
| 5,625,659 | A | | 4/1997 | Sears |
| D392,136 | S | | 3/1998 | Ross et al. |
| 5,779,104 | A | | 7/1998 | Reidel |
| 5,781,942 | A | | 7/1998 | Allen et al. |
| 5,810,201 | A | | 9/1998 | Besse et al. |
| 5,829,636 | A | | 11/1998 | Vuong et al. |
| 5,906,299 | A | | 5/1999 | Hagleitner |
| 5,944,227 | A | | 8/1999 | Schroeder et al. |
| 5,960,991 | A | * | 10/1999 | Ophardt ..... 222/1 |
| D416,417 | S | | 11/1999 | Ross et al. |
| 5,992,698 | A | | 11/1999 | Copeland et al. |
| 5,996,851 | A | | 12/1999 | Dolan et al. |
| 6,036,056 | A | | 3/2000 | Lee et al. |
| 6,053,364 | A | | 4/2000 | van der Heijden |
| 6,065,639 | A | | 5/2000 | Maddox et al. |
| 6,068,162 | A | | 5/2000 | De Winter et al. |
| 6,082,586 | A | | 7/2000 | Banks |
| 6,152,330 | A | | 11/2000 | Polan |
| 6,158,620 | A | | 12/2000 | Polan |
| 6,161,726 | A | | 12/2000 | Parsons et al. |
| 6,206,238 | B1 | | 3/2001 | Ophardt |
| 6,209,184 | B1 | | 4/2001 | Copeland et al. |
| 6,209,752 | B1 | | 4/2001 | Mitchell et al. |
| D449,753 | S | | 10/2001 | DeKoning et al. |
| 6,325,245 | B1 | | 12/2001 | Matthews |
| 6,386,390 | B1 | | 5/2002 | Tinker |
| 6,390,329 | B1 | | 5/2002 | Maddox |
| 6,394,315 | B1 | | 5/2002 | Banks |
| 6,404,837 | B1 | | 6/2002 | Thompson et al. |
| 6,409,050 | B1 | | 6/2002 | Ophardt et al. |
| D462,218 | S | | 9/2002 | DeKoning et al. |
| 6,446,840 | B2 | | 9/2002 | Ophardt et al. |
| 6,467,651 | B1 | | 10/2002 | Muderlak et al. |
| 6,533,145 | B2 | | 3/2003 | Lewis et al. |
| 6,540,117 | B2 | | 4/2003 | Powling |
| 6,542,568 | B1 | | 4/2003 | Howes, Jr. et al. |
| 6,543,651 | B2 | | 4/2003 | Lewis et al. |
| 6,557,729 | B2 | | 5/2003 | Gauthier |
| 6,568,561 | B2 | | 5/2003 | Studer et al. |
| 6,575,334 | B2 | | 6/2003 | Lewis et al. |
| 6,575,335 | B2 | | 6/2003 | Lewis et al. |
| 6,581,801 | B2 | | 6/2003 | Gauthier |
| 6,601,736 | B2 | | 8/2003 | Ophardt et al. |
| 6,619,509 | B2 | | 9/2003 | DeKoning et al. |
| 6,626,332 | B2 | | 9/2003 | Ehrensperger et al. |
| 6,644,516 | B1 | | 11/2003 | Foster et al. |
| 6,648,179 | B2 | | 11/2003 | Lewis et al. |
| 6,651,851 | B2 | | 11/2003 | Muderlak et al. |
| D483,974 | S | | 12/2003 | Reed |
| 6,669,909 | B2 | | 12/2003 | Shvets et al. |
| D484,721 | S | | 1/2004 | Chou |
| 6,691,893 | B2 | | 2/2004 | Gauthier |
| 6,698,616 | B2 | | 3/2004 | Hidle et al. |
| 6,729,502 | B2 | | 5/2004 | Lewis et al. |
| 6,758,372 | B2 | | 7/2004 | Studer et al. |
| D493,647 | S | | 8/2004 | Bowes |
| 6,769,580 | B2 | | 8/2004 | Muderlak et al. |
| 6,793,105 | B1 | | 9/2004 | Ouyoung |
| 6,820,770 | B2 | | 11/2004 | Makino et al. |
| 6,830,557 | B2 | | 12/2004 | Paul |
| 6,923,346 | B2 | | 8/2005 | Foster et al. |
| 6,929,150 | B2 | | 8/2005 | Muderlak et al. |
| 6,956,498 | B1 | | 10/2005 | Gauthier et al. |
| 6,957,751 | B2 | | 10/2005 | Ophardt |
| 7,004,356 | B1 | | 2/2006 | Sayers |
| 7,191,920 | B2 | | 3/2007 | Boll et al. |
| 7,896,196 | B2 | | 3/2011 | Wegelin et al. |
| 8,109,411 | B2 | | 2/2012 | Yang et al. |
| 2004/0050875 | A1 | | 3/2004 | Kobayashi |
| 2004/0050876 | A1 | | 3/2004 | Muderlak et al. |
| 2004/0226962 | A1 | | 11/2004 | Mazursky et al. |
| 2004/0251271 | A1 | | 12/2004 | Jackson et al. |
| 2005/0087557 | A1 | | 4/2005 | Oliver et al. |
| 2005/0127099 | A1 | | 6/2005 | Chou |
| 2005/0139612 | A1 | | 6/2005 | Matthews et al. |
| 2005/0233915 | A1 | | 10/2005 | Smith |
| 2005/0247735 | A1 | | 11/2005 | Muderlak et al. |
| 2005/0258192 | A1 | | 11/2005 | Matthews et al. |
| 2006/0011655 | A1 | | 1/2006 | Ophardt |
| 2006/0175341 | A1 | | 8/2006 | Rodrian |
| 2006/0243740 | A1 | | 11/2006 | Reynolds et al. |
| 2009/0101671 | A1 | | 4/2009 | Cittadino et al. |
| 2010/0012679 | A1 | | 1/2010 | Brownlee |
| 2011/0017778 | A1 | | 1/2011 | Kadiks et al. |

OTHER PUBLICATIONS

Kimberly-Clark Professional, Dispensers-Soaps-Product Code: 92044, 2005.

Kimberly-Clark Professional , Dispensers-Soaps_SaniTUFF-Product Code: 92013, 2005.

Kimberly-Clark Professional, Dispensers-Soaps-OnePak, 2005.

Kimberly-Clark Professional, Dispensers-Soaps-Twinpak, 2005.

Kimberly-Clark Professional, Dispensers-Soaps-Mini/500, 2005.

Kimberly-Clark Professional Brochure, "Professional Skin Care Products and Systems," Mar. 2003.

PCT International Search Report, Date of Mailing: Jul. 9, 2009, International Application No. PCT/US2008/080602.

PCT International Search Report, Date of Mailing: Jul. 14, 2011, International Application No. PCT/US2012/046501.

* cited by examiner

PUMPING DISPENSER SHIELD

BACKGROUND OF THE INVENTION

Dispensers have been developed that dispense liquids or foams such as soap, lotions, sanitizers or other products. Some dispensers include an electromechanical pumping mechanism. The pumping mechanism may be actuated by a control system using logic. The control system may include a proximity sensor such as, an infrared, sonar, radar, laser, or optical sensor to detect an object placed near the sensor. In this regard, the hand of a user may be placed near the proximity sensor, which initiates the dispensing mechanism.

BRIEF DESCRIPTION OF THE INVENTION

An embodiment of the invention includes a dispenser apparatus for dispensing a flowable material includes a chassis portion, a sensor disposed proximate the chassis portion for sensing a presence of an object, a pump assembly arranged on the chassis portion, operative to dispense the flowable material responsive to receiving a signal from the sensor, and a shield member disposed proximate to the sensor.

Another embodiment of the invention includes a shield member for a dispenser apparatus for dispensing a flowable material includes a first sidewall a second sidewall, the second sidewall opposing the first sidewall, a front wall, and a lip portion extending from the front wall.

DETAILED DESCRIPTION OF THE INVENTION

Figure 1:
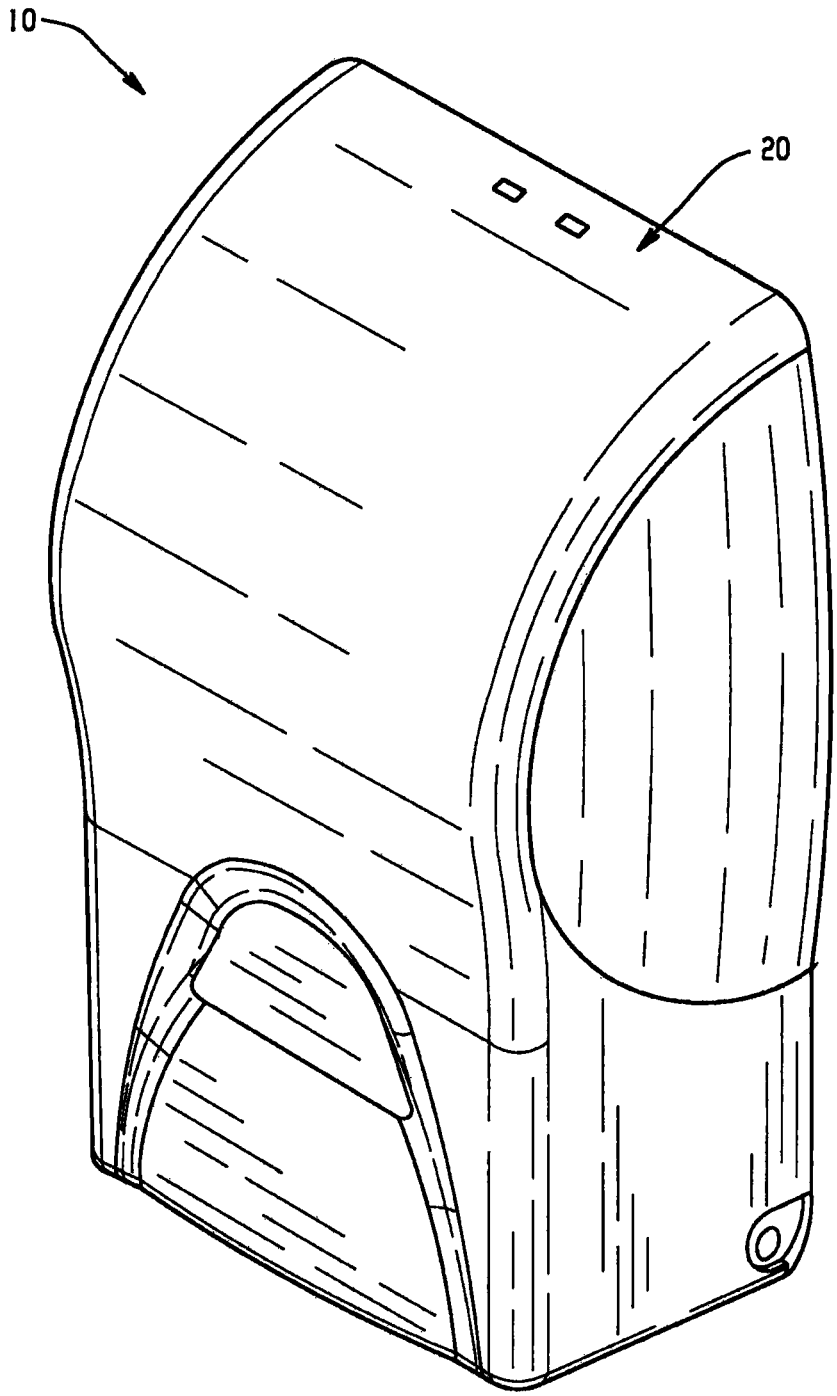
FIG. 1 is a front isometric view schematic of a pumping dispenser in accordance with an exemplary embodiment.
Figure 2:
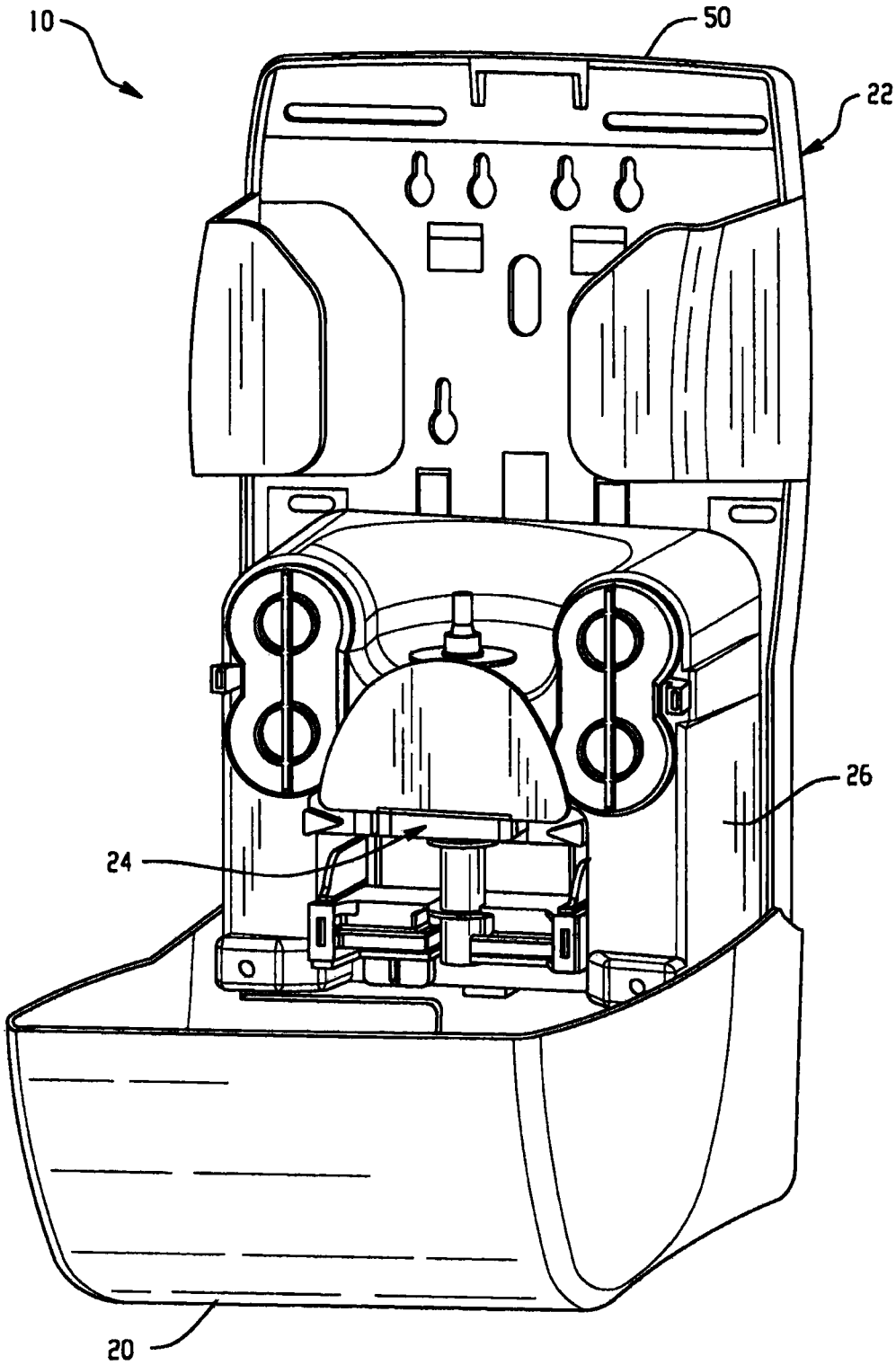
FIG. 2 is another front isometric view schematic of the pumping dispenser of FIG. 1 with a cover open.
Figure 3:
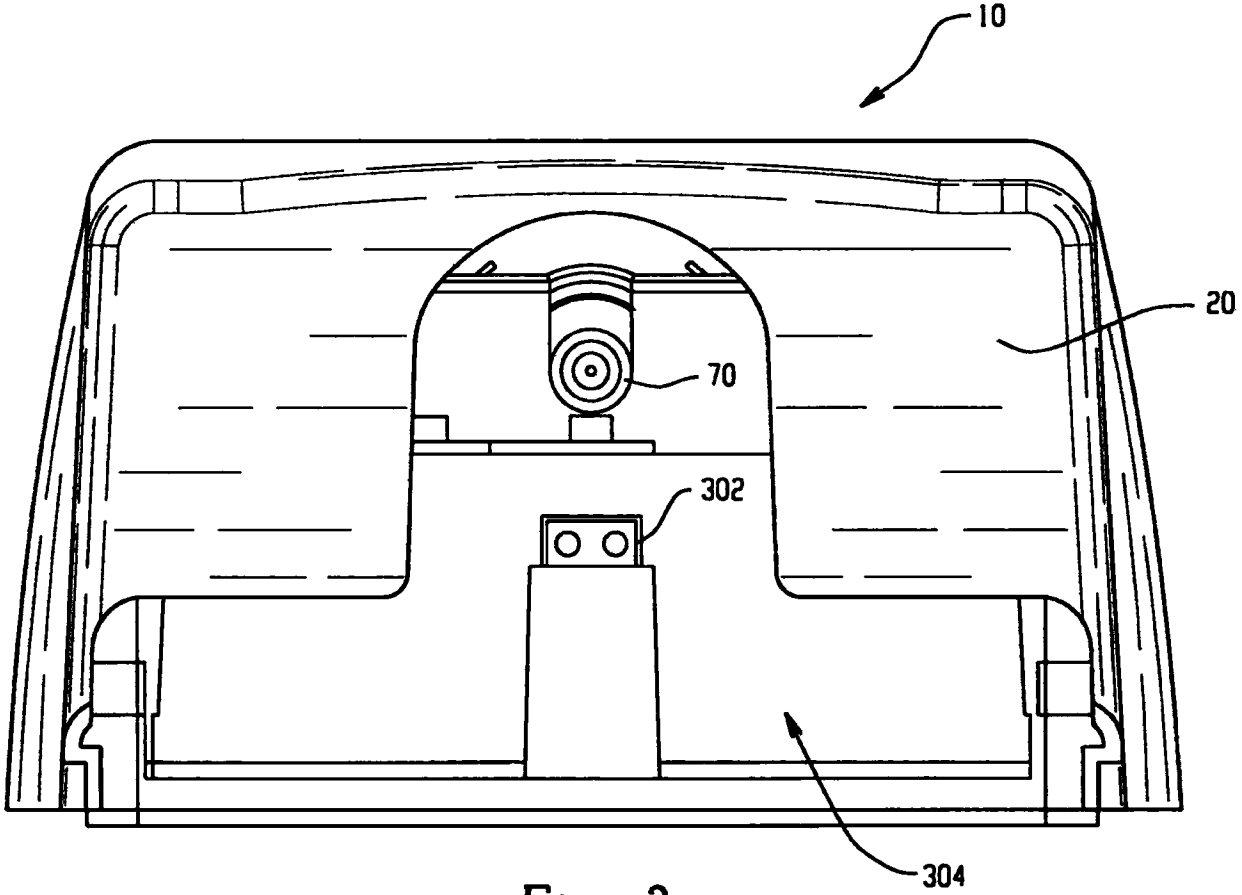
FIG. 3 is a bottom view schematic of the pumping dispenser of FIG. 1.

Referring to FIGS. 1-3, an example pumping dispenser 10 for automatically dispensing a liquid or foam, more generally referred to as a flowable material, is illustrated. While reference is made herein to soap or liquid soap, it will be appreciated that the scope of the invention is not so limited, and extends to other flowable products, such as liquid, foam, gel, lotion, detergent, or any other flowable product capable of being pumped from a dispenser, for example.

Referring to FIG. 1, the housing cover 20 is provided to enclose internal components of the pumping dispenser (dispenser) 10. In an embodiment the housing cover 20 is rotatably coupled to a chassis portion and can rotate between first and second rotational positions.

Referring to FIG. 2, a back housing 22 is provided to support the chassis portion (casing) 26 thereon. The chassis portion 26 is fixedly coupled to the plate 50. The chassis portion 26 holds a liquid container (not shown) of the pumping assembly 24.

FIG. 3 illustrates a bottom view of the pumping dispenser 10 including an extension nozzle (nozzle) 70 that is operative to dispense a liquid pressurized by the pumping assembly 24 and a proximity sensor (sensor) 302. The proximity sensor 302 is provided to detect when an object, such as a users' hand, is disposed under the pumping dispenser 10. The proximity sensor 302 is arranged relative to the extension nozzle 70 such that a hand of a user is in a position to receive dispensed liquid when the hand is sensed by the proximity sensor 302. In particular, the proximity sensor 302 generates an output signal when an object is detected under the pumping dispenser 10, which is received by a controller (not shown). The proximity sensor 302 is disposed on a bottom portion 304 of the chassis portion 26. In the illustrated embodiment, the proximity sensor 302 includes an infrared device, alternate embodiments may include any type of proximity sensor including, for example, a sonar, radar, optical, or laser device.

Figure 4:
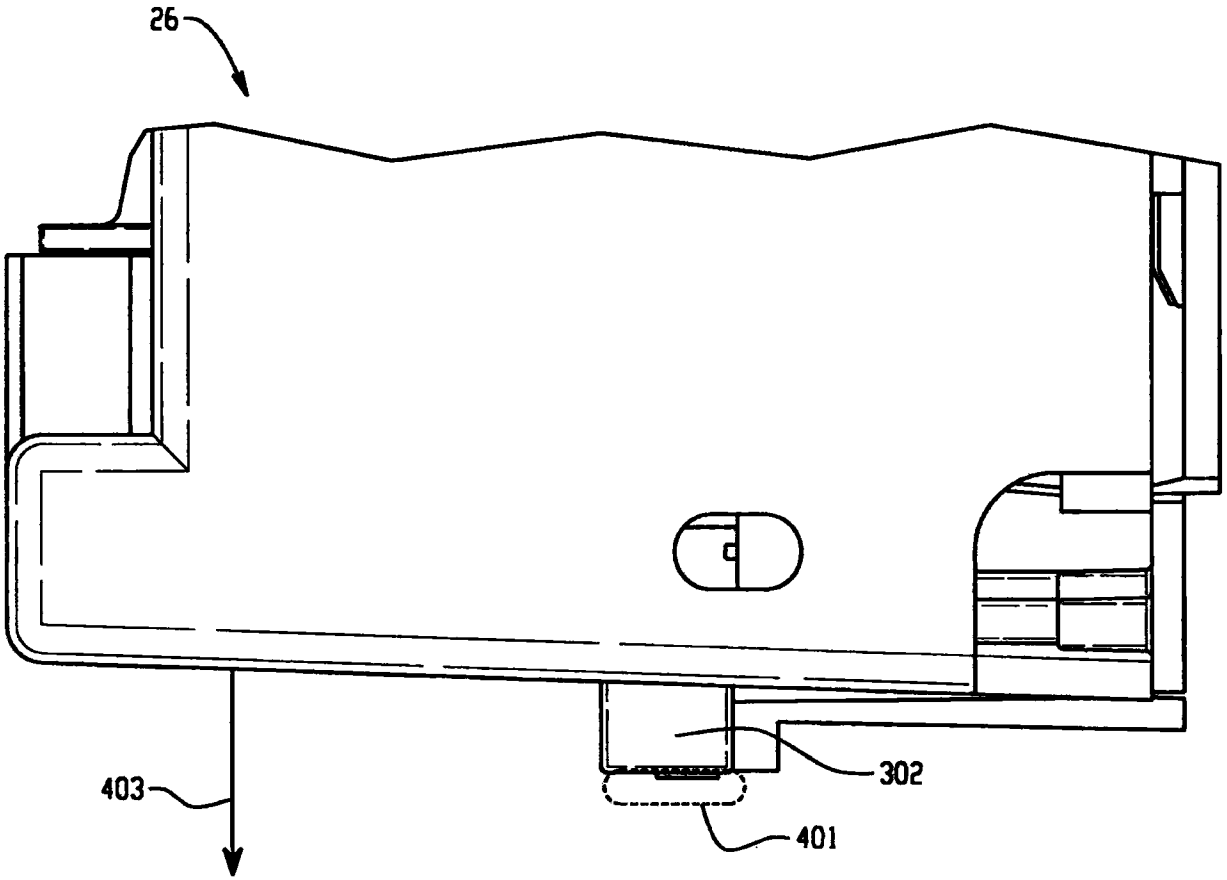
FIG. 4 illustrates a side view of a portion of the chassis portion and the proximity sensor of the pumping dispenser of FIG. 1.
Figure 5:
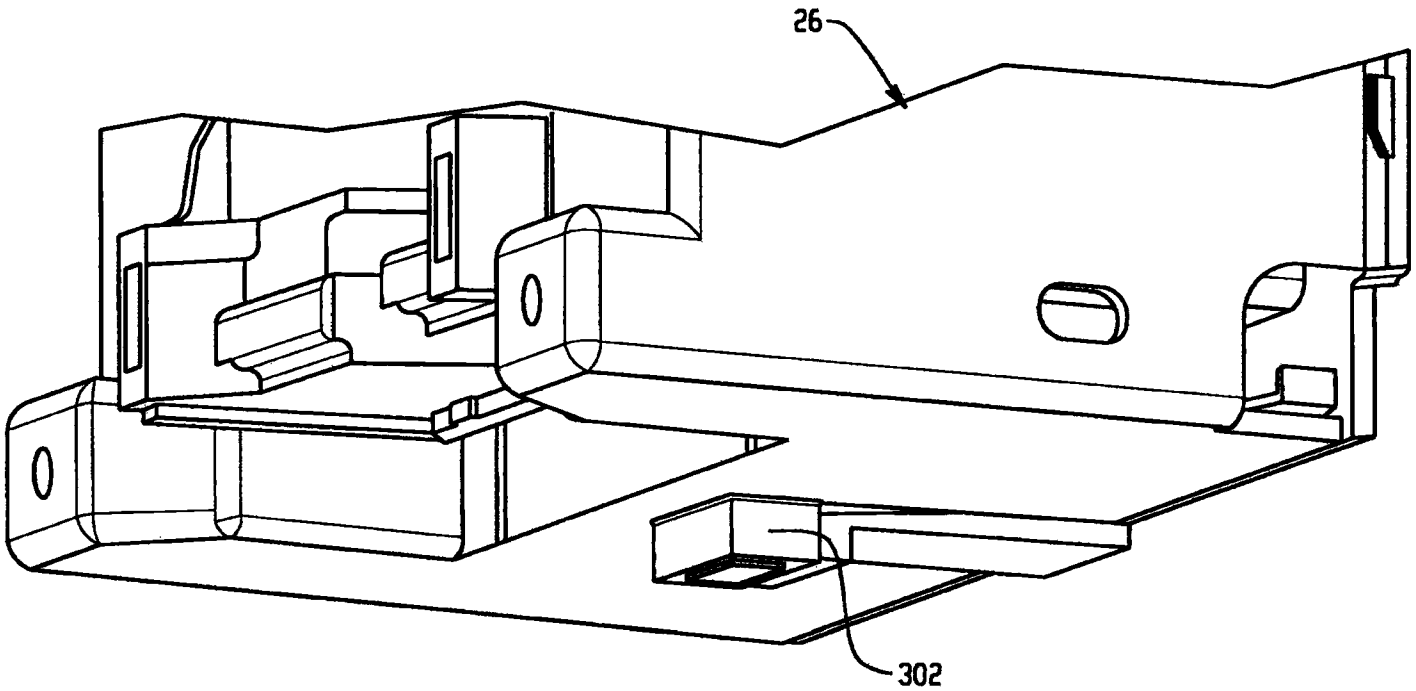
FIG. 5 illustrates a perspective view of the chassis portion and the proximity sensor of the pumping dispenser of FIG. 1.

FIG. 4 illustrates a side view of a portion of the chassis portion 26 and the proximity sensor 302. FIG. 5 illustrates a perspective view of the chassis portion 26 and the proximity sensor 302. Referring to FIG. 4, in operation, the flowable liquid dispensed through the extension nozzle 70 (of FIG. 3) may undesirably accumulate in the region 401. The accumulation of flowable liquid may interfere with the operation of the proximity sensor 302 by obscuring the proximity sensor 302. Flowable liquid in some embodiments may drip as indicated by the arrow 403. The liquid may be sensed by the proximity sensor 302, resulting in the pumping dispenser 10 undesirably dispensing flowable liquid.

Figure 6:
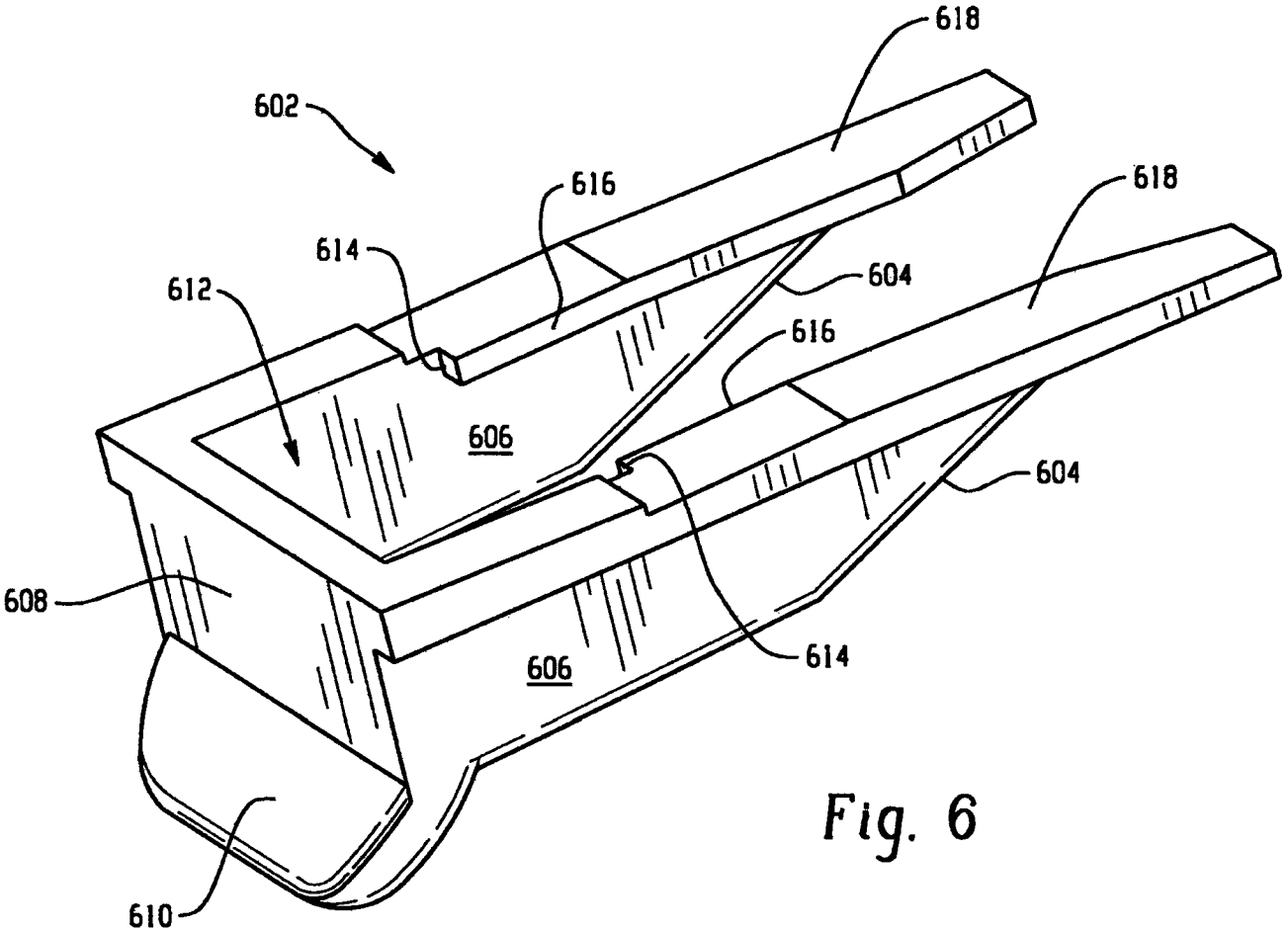
FIG. 6 illustrates an exemplary embodiment of a sensor shield member.

FIG. 6 illustrates an exemplary embodiment of a sensor shield member (shield) 602. The shield 602 is installed proximate to the proximity sensor 302 and is operative to reduce or prevent an accumulation of flowable liquid on the proximity sensor 302, and to reduce incidents of undesired dispensing due to sensing dripping flowable liquids. In this regard, the shield 602 includes a body portion 604 having side walls 606 and a front wall 608. The side walls 606 define substantially parallel planes while the front wall 608 defines a plane substantially perpendicular to the side walls 606. A lip portion 610 extends at an oblique angle from the front wall 608. The side walls 606 and the front wall 608 define an aperture 612 that is sized and shaped to slidably engage the proximity sensor 302. The shield 602 includes notches 614 defined by the sidewalls 606 and tabs 616. The tabs 616 define planar surfaces 618. The shield 602 may be formed from any suitable material including, for example, a thermoplastic or polymer material. Though the lip portion 610 of the illustrated exemplary embodiment is shown at an oblique angle, the lip portion 610 may be arranged at any appropriate angle relative to the front wall 608. For example, the lip portion 610 may extend coplanar with the front wall 608 (i.e., at a zero degree angle relative to the front wall 608.)

Figure 7A:
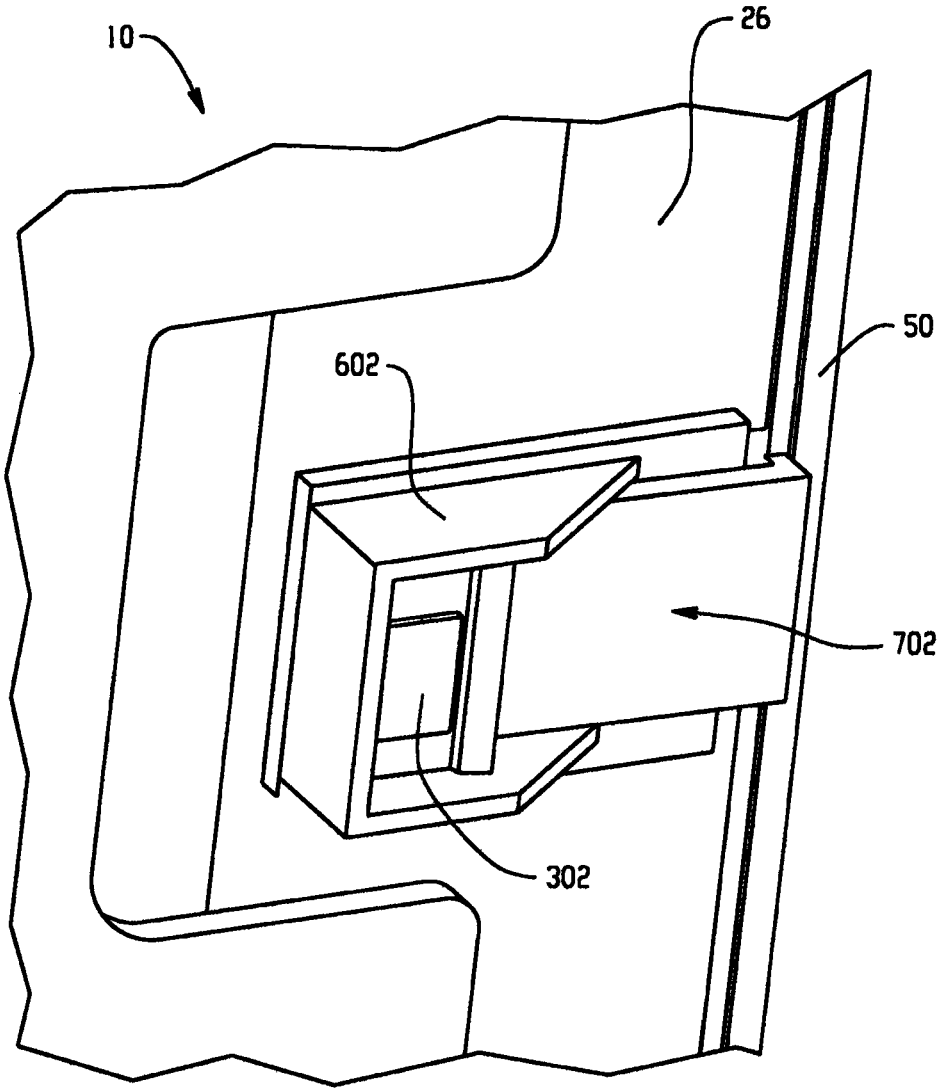
FIG. 7A illustrates a perspective view of the shield of FIG. 6 arranged on the pumping dispenser of FIG. 1.

FIG. 7A illustrates a perspective view of the shield 602 installed on the pumping dispenser 10. The shield 602 in the illustrated embodiment is deformable such that the side walls 606 and tabs 616 may be flexed to allow aperture 612 (of FIG. 6) to engage and snap-fit about the proximity sensor 302 (of FIG. 7A). The planar surfaces 618 of the tabs 616 may contact the chassis portion 26 while the tabs 616 engage and be retained by a gap defined by the chassis portion 26 and an extension member (region) 702 chassis portion 26. Though the shield 602 of the illustrated embodiment is shown as a separate component, the shield 602 may be formed integrally with, for example, the proximity sensor 302 or the chassis portion 26. The lip portion 610 (of FIG. 6) may also be formed integrally with the proximity sensor 302 or the chassis portion 26. In such an embodiment, the lip portion 610 may extend from the proximity sensor 302 or the chassis portion 26 with or without the shield 602, such that the lip portion 610 is formed from and extends from the proximity sensor 302 and/or the chassis portion 26 material.

Figure 7B:
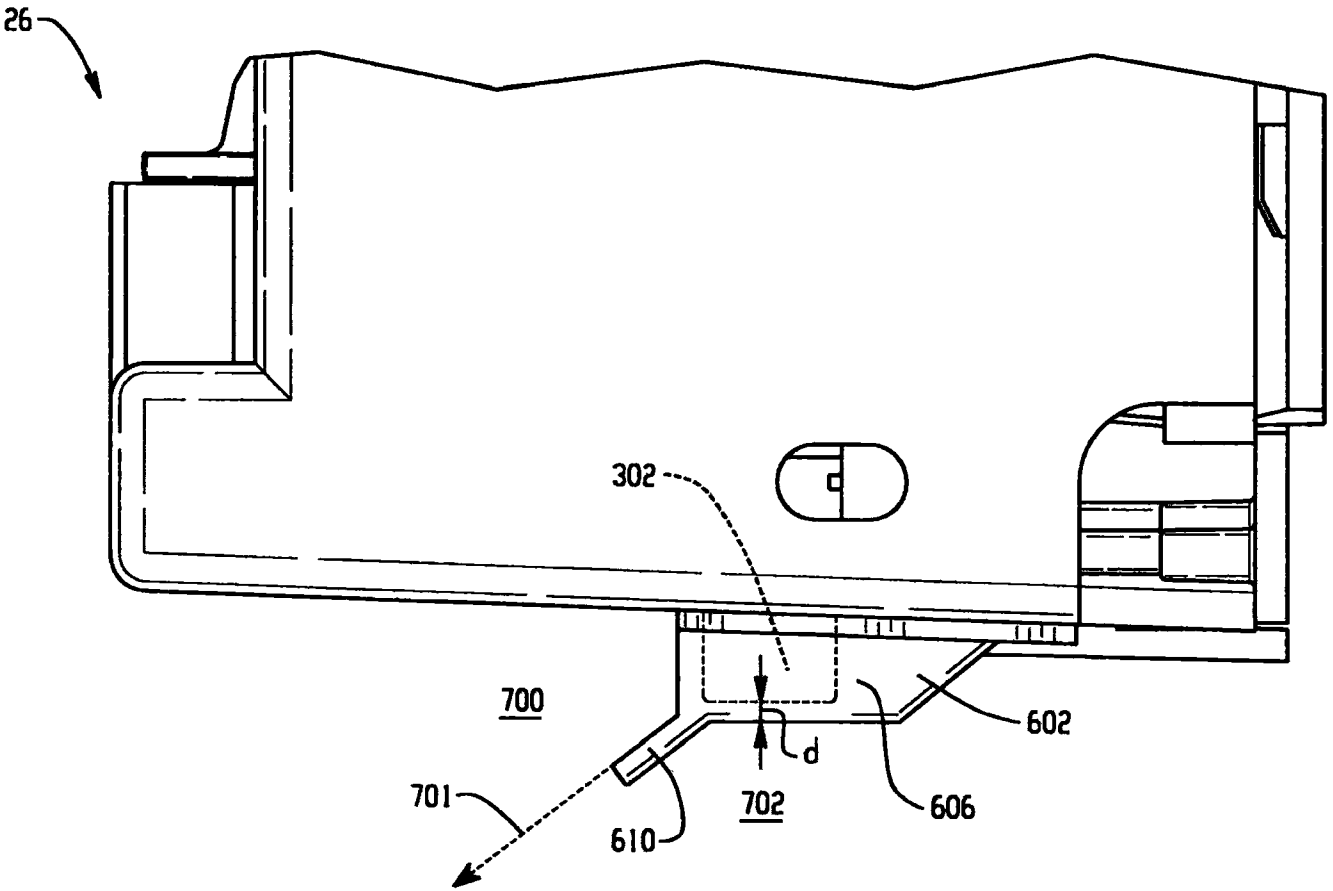
FIG. 7B illustrates a side view of the shield of FIG. 6 arranged on the pumping dispenser of FIG. 1.

FIG. 7B illustrates a side partially cut-away view of the shield 602 installed on the pumping dispenser 10. The lip portion 610 defines a plane 701 that partially defines a region 700 and a region 702. The region 700 is obscured from the proximity sensor 302 by the shield 602, thus an object placed or moved in the region 700 is not detected by the proximity sensor 302, while an object placed or moved in the region 702 may be detected by the proximity sensor 302. The side walls 606 extend a distance (d) below the proximity sensor 302 and are operative to prevent fluid from pooling and dripping from the proximity sensor 302.

Figure 8:
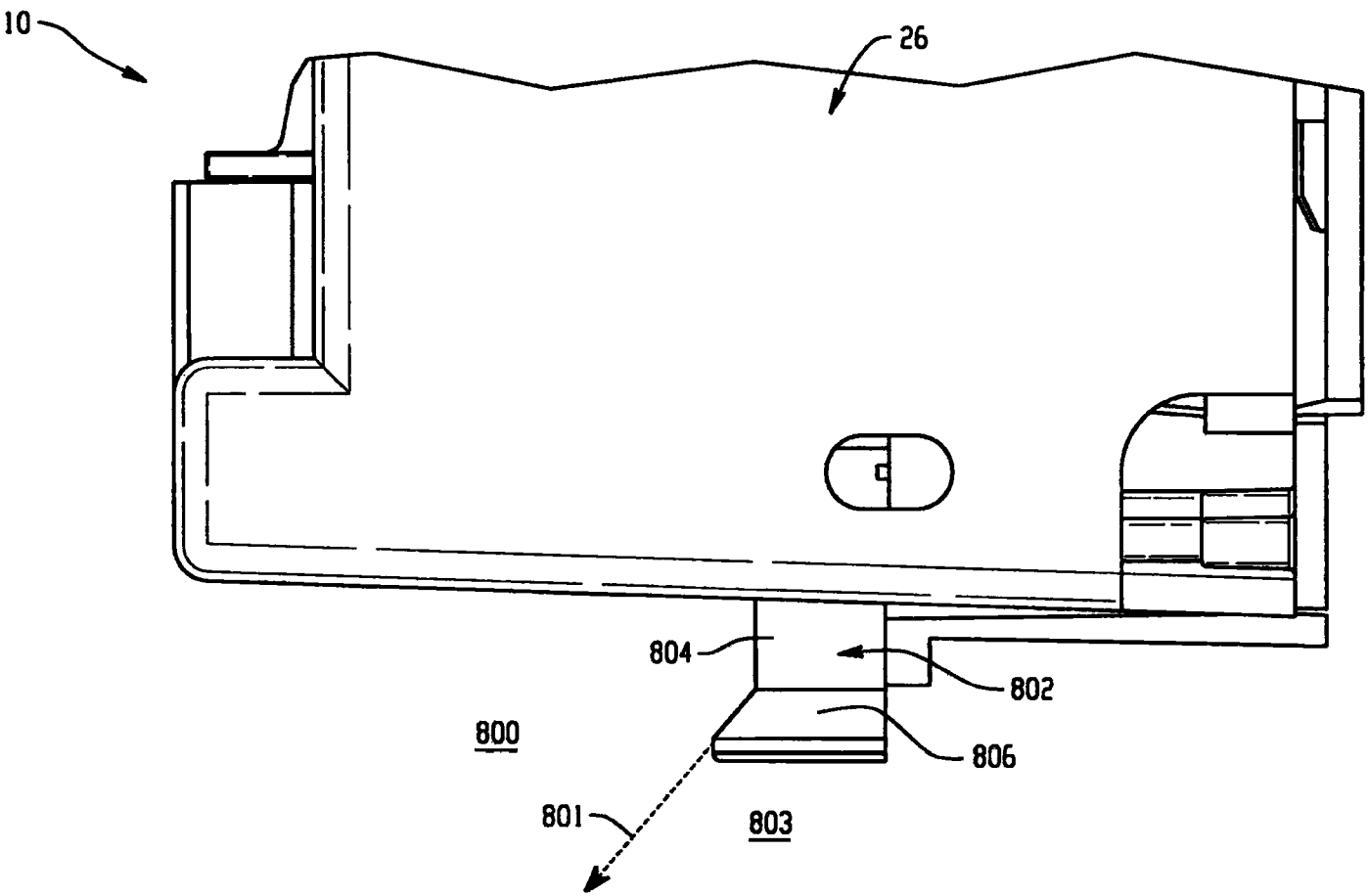
FIG. 8 illustrates a side view of an alternate embodiment of a shield arranged on the pumping dispenser of FIG. 1.
Figure 9:
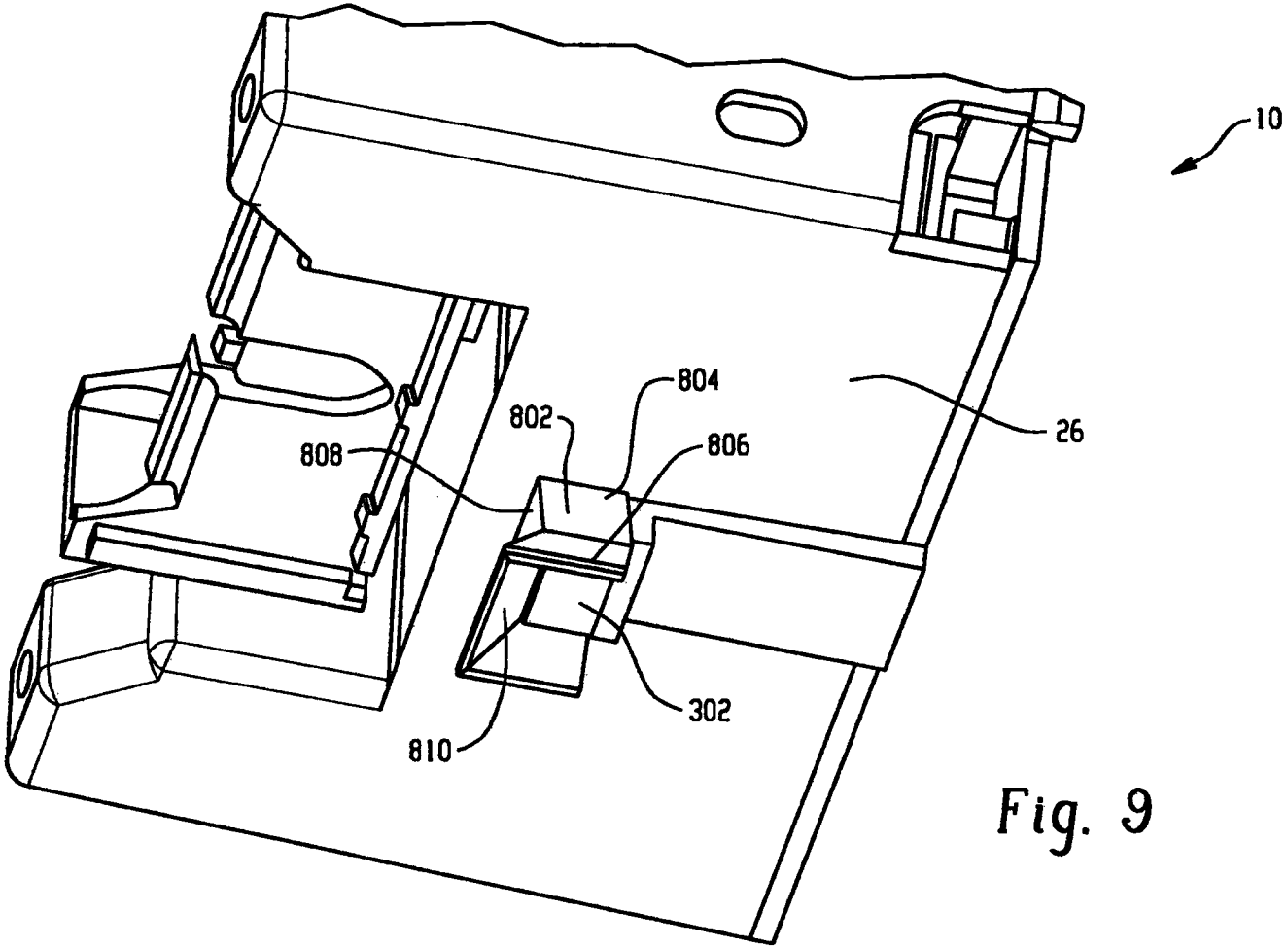
FIG. 9 illustrates a side view of an alternate embodiment of a shield arranged on the pumping dispenser of FIG. 1.

FIGS. 8 and 9 illustrate a side view and perspective view respectively of an alternate embodiment of a shield 802 arranged on the pumping dispenser 10. Referring to FIG. 8, the shield 802 includes a body portion having sidewalls 804 and shield portions 806 extending at an oblique angle from the sidewalls 804. FIG. 9 illustrates a front wall 808 and a shield portion 810 extending at an oblique angle from the front wall 808. The shield 802 may be arranged on the pumping dispenser 10 using any appropriate means including for example, a snap-fit arrangement, a fastener, an adhesive, or using a welding process. Though the shield 802 of the illustrated embodiment is shown as a separate component, the shield 802 portion may be formed integrally with, for example, the proximity sensor 302 or the chassis portion 26.

Referring to FIG. 8, in operation, the plane 801 partially defines a region 800 and a region 803. The region 800 is obscured from the proximity sensor 302 (of FIG. 9) by the shield 802. Thus, the motion or placement of an object in the region 800 is not detected by the proximity sensor 302, while motion or placement of an object in the region 803 may be detected by the proximity sensor 302.

While the invention has been described with reference to exemplary embodiments, it will be understood by those skilled in the art that various changes may be made and equivalent elements may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed for carrying this invention, but that the invention will include all embodiments falling within the scope of the appended claims. Moreover, the use of the terms, first, second, etc. are used to distinguish one element from another. Furthermore, the use of the terms a, an, etc. do not denote a limitation of quantity, but rather denote the presence of at least one of the referenced items.

What is claimed is:

1. A dispenser apparatus for dispensing a flowable material, the apparatus comprising:

a chassis portion;

a sensor disposed proximate the chassis portion for sensing a presence of an object;

a pump assembly arranged on the chassis portion, the pump assembly operative to dispense the flowable material from a nozzle tip responsive to receiving a signal from the sensor; and a sensor shield member including a front wall disposed between the sensor and the nozzle tip;

wherein the sensor is disposed below the nozzle tip; and wherein the sensor shield member extends below the sensor.

2. The device of claim 1, wherein the shield member is operative prevent the sensor from sensing the presence of an object in a region partially defined by the shield member.

3. The device of claim 1, wherein the sensor shield member includes a portion disposed below the sensor and operative to reduce accumulation of the flowable material on the sensor.

4. The device of claim 1, wherein the shield member includes a portion arranged at an oblique angle to the chassis portion and extending below the sensor.

5. The device of claim 1, wherein the shield member includes:

a first sidewall;

a second sidewall, the second sidewall opposing the first sidewall;

and a lip portion extending from the front wall and below the sensor.

6. The device of claim 5, wherein the lip portion is arranged at an oblique angle to the front wall.

7. The device of claim 5, wherein the shield member further includes:

a first tab portion arranged on the first sidewall;

a second tab portion arranged on the second sidewall, wherein the first tab portion and the second tab portion are operative to slidably engage a portion of the chassis portion.

8. The device of claim 5, wherein the first side wall, the second sidewall, and the front wall partially define an aperture operative to slidably engage the sensor.

9. The device of claim 1, wherein the shield member includes:

a first sidewall;

a second sidewall, the second sidewall opposing the first sidewall;

and a first shield portion extending from the front wall.

10. The device of claim 9, wherein the shield member includes a second shield portion extending from the first sidewall.

11. The device of claim 9, wherein the shield member includes a third shield portion extending from the second sidewall.

12. The device of claim 1, wherein the flowable material comprises at least one of a liquid soap, a liquid lotion, a sanitizer liquid, and an antimicrobial liquid.

13. A shield member for a dispenser apparatus for dispensing a flowable material including:

a first sidewall;

a second sidewall, the second sidewall opposing the first sidewall;

a front wall; and a lip portion extending from the front wall;

wherein the first sidewall, the second sidewall, and the front wall partially define an aperture operative to slidably engage a portion of the dispenser apparatus about a proximity sensor such that the lip portion is disposed between the proximity sensor and a nozzle tip.

14. The device of claim 13, wherein the lip portion is arranged at an oblique angle to the front wall.

15. The device of claim 13, wherein the shield member further includes:

a first tab portion arranged on the first sidewall;

a second tab portion arranged on the second sidewall, wherein the first tab portion and the second tab portion are operative to slidably engage a portion of the chassis portion of the dispenser apparatus proximate to the proximity sensor.

16. The device of claim 13, wherein the shield member is operative to prevent the proximity sensor from sensing the presence of an object in a region partially defined by the lip portion.

17. The device of claim 13, wherein the shield member is operative to reduce accumulation of the flowable material on the proximity sensor.

18. A dispenser apparatus for dispensing a flowable material, the apparatus comprising:

a chassis portion;

a sensor disposed proximate the chassis portion for sensing a presence of an object;

a pump assembly arranged on the chassis portion, operative to dispense the flowable material responsive to receiving a signal from the sensor; and a lip portion disposed proximate to the sensor and the nozzle tip.

wherein the sensor is disposed below the nozzle tip; and wherein the lip portion extends below the sensor.

19. The apparatus of claim 18, wherein the lip portion extends from the chassis portion.

20. The apparatus of claim 18, wherein the lip portion is arranged at an oblique angle to the chassis portion.

21. The device of claim 1, wherein the sensor shield member partially defines a sensing region and a dispensing region separate from the sensing region.

22. The device of claim 1, wherein the sensor shield member partially defines a dispensing region outside of the sensor shield member.

23. The device of claim 1, wherein the sensor shield member partially defines a dispensing region in front of the sensor shield member.

24. The device of claim 1, wherein the front wall partially defines a sensing region behind the front wall and a dispensing region in front of the wall.

25. The device of claim 1, wherein the sensor shield member comprises a lip portion extending from the front wall, wherein the lip portion partially defines a sensing region behind the lip portion and a dispensing region in front of the lip portion.

26. The device of claim 1, wherein the sensor shield member is operative to reduce accumulation of the flowable material on the sensor or to reduce incidents of dispensing due to the sensor sensing a presence of dripping flowable material.

* * * * *

UNITED STATES PATENT AND TRADEMARK OFFICE

CERTIFICATE OF CORRECTION

PATENT NO. : 8,651,328 B2
APPLICATION NO. : 13/182674
DATED : February 18, 2014
INVENTOR(S) : Antonio M. Cittadino It is certified that error appears in the above-identified patent and that said Letters Patent is hereby corrected as shown below:

In the Claims:

In Column 4, Line 6, Claim 2, after "wherein the", insert -- sensor --.
In Column 4, Line 7, Claim 2, after "operative", insert -- to --.
In Column 4, Line 12, Claim 4, after "wherein the", insert -- sensor --.
In Column 4, Line 15, Claim 5, after "wherein the", insert -- sensor --.
In Column 4, Line 25, Claim 7, after "wherein the", insert -- sensor --.
In Column 4, Line 32, Claim 8, after "wherein the first", delete "side wall" and insert -- sidewall --.
In Column 4, Line 35, Claim 9, after "wherein the", insert -- sensor --.
In Column 4, Line 41, Claim 9, after "from the front wall", insert -- and below the sensor --.
In Column 4, Line 42, Claim 10, after "wherein the", insert -- sensor --.
In Column 4, Line 45, Claim 11, after "wherein the", insert -- sensor --.
In Column 5, Line 4, Claim 15, after "slidably engage a", delete "portion of the".
In Column 5, Line 7, Claim 16, after "wherein the", delete "shield member" and insert
-- lip portion --.
In Column 5, Line 11, Claim 17, after "wherein the", delete "shield member" and insert
-- lip portion --.
In Column 5, Line 19, Claim 18, after "the chassis portion," insert -- the pump assembly --.
In Column 5, Line 22, Claim 18, after "portion disposed", delete "proximate to" and insert
-- between --.

Signed and Sealed this
Sixth Day of May, 2014

Michelle K. Lee

Michelle K. Lee
*Deputy Director of the United States Patent and Trademark Office*